United States Patent [19]

Coombes, Jr.

[11] Patent Number: 4,936,973

[45] Date of Patent: Jun. 26, 1990

[54] OVERFLOW ASSEMBLY FOR PLATABLE PLASTIC SUBSTRATES

[75] Inventor: Robert L. Coombes, Jr., La Canada-Flintridge, Calif.

[73] Assignee: Crown City Plating Co., El Monte, Calif.

[21] Appl. No.: 286,479

[22] Filed: Dec. 19, 1988

[51] Int. Cl.[5] ..... C25D 7/00; C25D 17/08

[52] U.S. Cl. ..... 204/279; 204/297 W

[58] Field of Search ..... 204/297 R, 297 W, 20, 204/279; 118/620

[56] References Cited

U.S. PATENT DOCUMENTS

| | | | |
|---|---|---|---|
| 3,167,493 | 1/1965 | Oelgoetz | 204/297 W |
| 4,014,778 | 3/1977 | Harrison | 204/297 W |
| 4,421,627 | 12/1983 | Lebaron | 204/297 W |
| 4,714,535 | 12/1987 | Coombes et al. | 204/297 W |

*Primary Examiner*—Donald R. Valentine

*Attorney, Agent, or Firm*—Christie, Parker & Hale

[57] ABSTRACT

A platable plastic product substrate assembly comprises at least one overflow assembly having a primary support, at least one secondary support extending from the primary support and at least one clip for engaging the framework of a plating rack. A product substrate is removably attached to each secondary support.

11 Claims, 2 Drawing Sheets

20
21
22
23
24
26
27
28
29
30
30a
31
32
33
34
13
14

OVERFLOW ASSEMBLY FOR PLATABLE PLASTIC SUBSTRATES

FIELD OF THE INVENTION

This invention relates to the art of plating on plastics and, more particularly, to an injected molded assembly comprising at least one product substrate and an overflow assembly on which product substrates are attached which includes clip means for attaching the overflow assembly to the framework of electroless and electrolytic plating racks.

BACKGROUND OF THE INVENTION

In recent years, many plated products comprise a molded plastic substrate which is first electrolessly plated and then electrolytically plated.

In conventional electroless plating processes, the plating substrate is first etched with a strong oxidizing acid or base. The etched substrate is then immersed in a solution containing a noble metal catalyst, e.g., a tin-palladium catalyst. If required, the substrate is then immersed in an activator solution, e.g., exposing the palladium of the tin-palladium catalyst. Finally, the activated substrate is immersed in an autocatalytic electroless plating solution where an initial coating of a conductive metal, such as copper or nickel, is established on the substrate by chemical deposition.

In a conventional electrolytic plating process, the electrolessly plated plastic substrate is first immersed in cleaning solutions and then activated by immersion in a dilute acid solution, e.g., a dilute sulfuric acid solution. It is then immersed in one or more electroplating baths wherein metal is deposited on the surface of the substrate electrolytically. In many applications, for example, layers of copper, nickel, and chromium are plated onto the substrate.

Conventional plating racks used in electroless and electrolytic plating processes comprise a metal framework having metal contacts for holding the plastic substrates on the rack. With electrolytic plating racks, the contacts also provide means for electrical communication between the racks and the plastic substrates. The plastic substrates are manually mounted on the contacts which hold the substrates firmly so that they do not fall off the racks in agitated plating solutions and, in the case of electrolytic plating racks, to provide uninterrupted electrical contact with the substrates.

The contacts are typically in the form of metal wire, rods, strips, and the like. Two or more contacts are usually used in a manner which applies pressure, generally in the form of a spring force or a gripping force, at two or more contact points on the substrate. These contact points are generally at locations on the substrate which are not seen when the substrate is assembled as a final product.

The number of substrates held by an electroless or electrolytic plating rack depends on the size of the rack, which in turn is usually dependent on the size of the plating tanks, and on the size of the substrates. It is not uncommon for an electroless or electrolytic plating rack to hold 25 or even 100 or more substrates. Since each substrate typically requires at least two rack contacts, it is apparent that such racks require a great deal of material and time to construct and are accordingly very expensive to build. Moreover, many substrates are difficult to hold and require complicated contact design. This further increases the expense of constructing the racks.

For very small substrates or for substrates which, because of their design, cannot be held directly by the rack contacts, the plating racks are designed so that the contacts grip or otherwise hold a runner or portion of a runner which is not removed from the substrate after it is molded. Here again, however, the rack must comprise separate contacts for each such runner. Such racks are expensive and time consuming to construct for the reasons mentioned above.

Not only are conventional plating racks expensive to build, their utility is restricted to the particular substrate or substrates for which it is designed. Once the production of that particular substrate is over, the use of that plating rack ceases and it must be discarded or rebuilt to hold a different substrate.

U.S. Pat. No. 4,714,535 assigned to Crown City Plating Co. overcomes these drawbacks by providing a product substrate assembly in which product substrates are attached to a runner system which comprises means for releasably engaging the framework of a plating rack. Thus, the product substrate assembly simply clips on or otherwise engages the plating rack framework, obviating the need for separate rack contacts for each product substrate.

SUMMARY OF THE INVENTION

The present invention provides an improvement of that described in the above mentioned U.S. Pat. No. 4,714,535, which is incorporated herein by reference. In the present invention, the product substrate assembly comprises at least one overflow assembly to which product substrates are removably attached. The overflow assembly comprises an overflow framework and means attached to and preferably integral with said overflow framework for releasably engaging the framework of a plating rack, i.e., electroless and/or electrolytic plating rack.

Preferred means for releasably engaging the framework of an electrolytic plating rack comprises one or more clips along the overflow framework for gripping the plating rack framework. A preferred means for releasably engaging the framework of an electroless plating rack comprises a second clip for releasably gripping an electroless plating rack framework. Another preferred means for releasably engaging the framework of an electroless plating rack comprises one or more capturing members which either captures or is captured by the framework of the electroless plating rack to thereby hold the substrate assembly within the electroless plating rack framework.

In a preferred embodiment of the invention, the overflow assembly comprises means for releasably engaging the framework of an electroless plating rack and means for releasably engaging the framework of an electrolytic plating rack.

In another preferred embodiment of the invention, the overflow assembly comprises spacers extending from the overflow framework for spacing the product substrate assembly from an adjacent product substrate assembly mounted on the framework of an electrolytic and/or electroless plating rack. Preferred spacers comprise coupling means for engaging adjacent product assemblies so that one product assembly can be stacked on top of an adjacent product assembly.

In yet another preferred embodiment of the invention, the overflow assembly comprises one or more robbers extending from the overflow framework to positions adjacent but spaced apart from selected areas, e.g., high current density areas, of the product substrate. The robbers reduce the current density of the adjacent product substrate areas, for example, to reduce "burning" of the formation of nodules on the product substrate.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
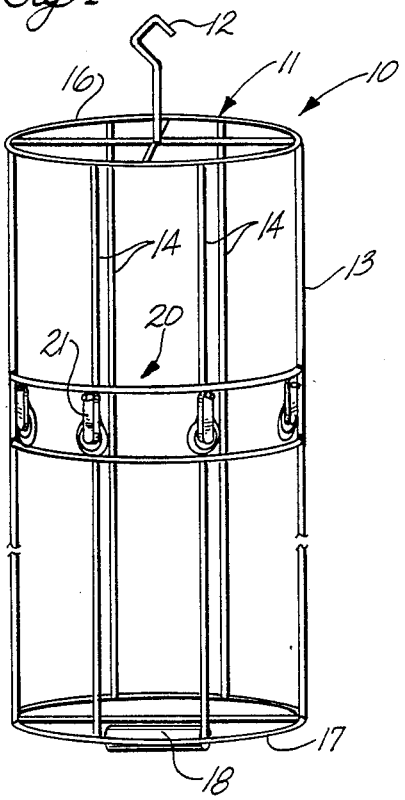
FIG. 1 is a perspective view of an electroplating rack useful with the present invention.

In the preferred practice of the present invention, there is provided a one-piece injection molded plastic product substrate assembly which can be mounted on the framework of an electrolytic plating rack and on the framework of an electroless plating rack. An electrolytic plating rack particularly suited for use with the product substrate assembly of the present invention has only a metal framework, i.e., having no contacts for holding product substrates. With reference to FIG. 1, such a plating rack 10 comprises a framework 11 which is immersed in various solutions during the course of an electroplating process. The framework 11 is suspended from a hook 12.

The hook 12 may be of any appropriate design for engaging the cathodic connection of the electroplating tank, whether that be a simple buss bar or the arm of an automatic electroplating machine. The framework 11 is made of metal, preferably stainless steel. Each side of the framework 11 comprises a pair of generally vertical side rails 13 and a pair of spaced apart center rails 14. The center rails 14 are spaced apart forwardly from the plane of the side rails 13 and are connected to the side rails 13 at their bottom ends by lower framing members 17. The upper and lower framing members 16 and 17 and the center and side rails 14 and 13 are covered with a generally non-platable coating, e.g., plastisol, to prevent plating on those members. Portions of the metal of the side rails 13 and center rails 14 are exposed to provide contact sites for electrical contact with the product substrate assemblies.

The electroplating rack 10 further comprises a weight 18, e.g., a lead block or the like at its lower end to prevent bouncing or jostling of the electroplating rack 10 when immersed in agitated solutions. The weight 18 assures uninterrupted contact between the hook 12 and the cathode connection, e.g., buss bar of the electroplating tank. The weight 18 is covered with a non-platable coating to prevent plating on it.

Figure 4:
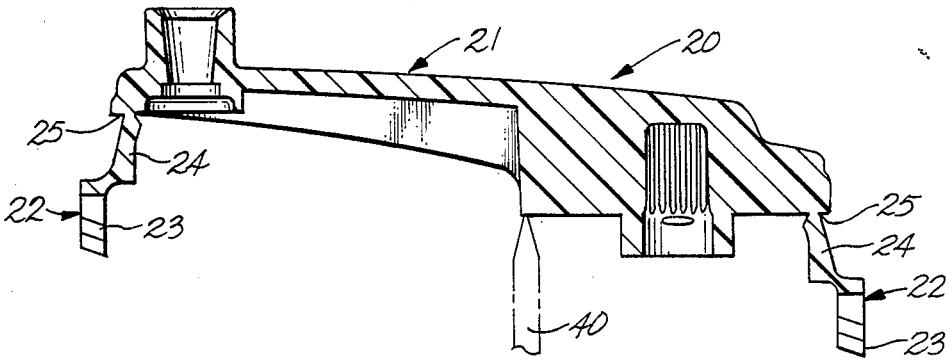
FIG. 4 is a side cross-sectional view of a product substrate of the product substrate assembly of FIG. 2.
Figures 2, 3:
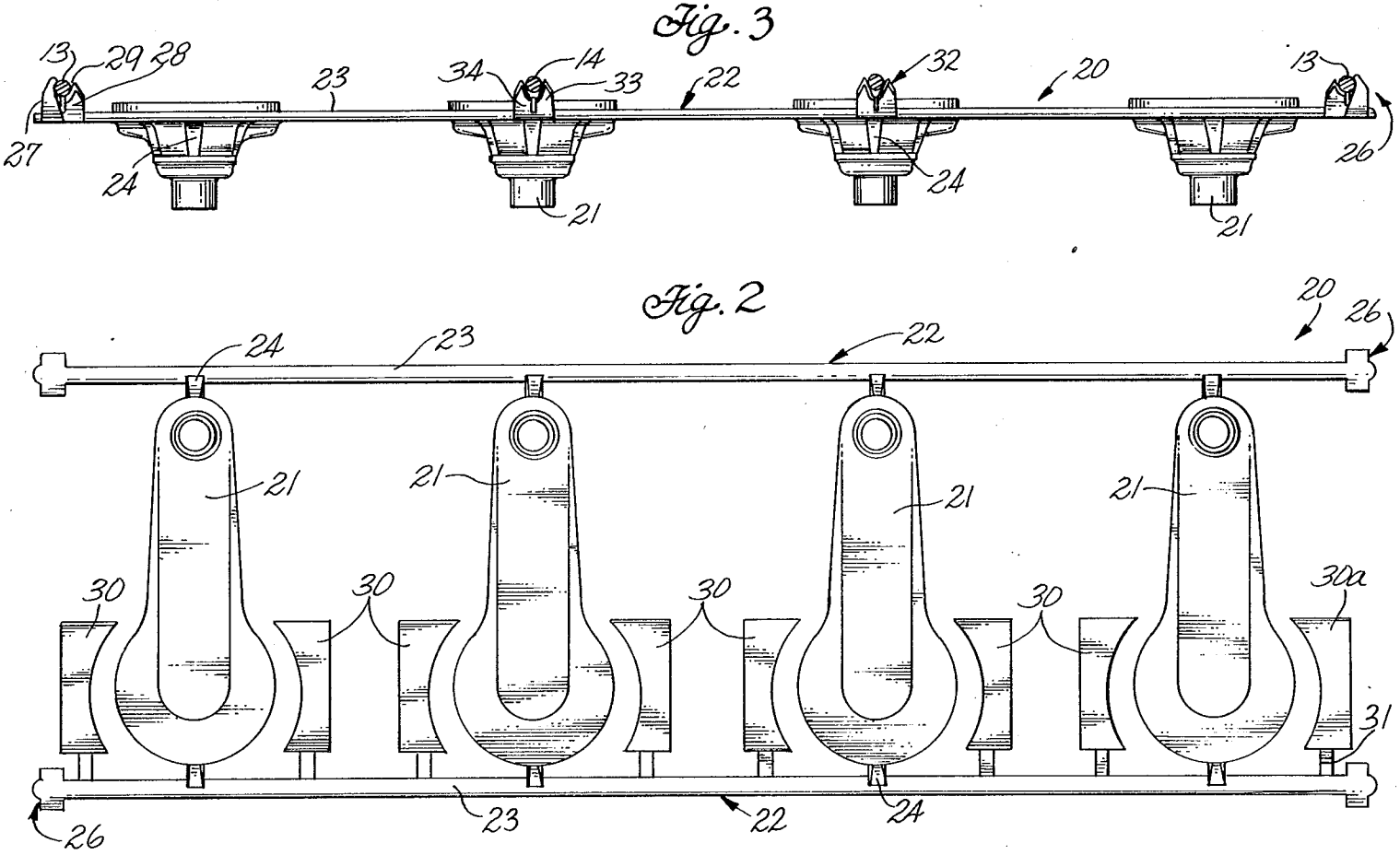
FIG. 2 is a front view of the product substrate assembly.
FIG. 3 is a top view of the product substrate assembly of FIG. 2.

With reference to FIGS. 2–4, there is shown a product substrate assembly constructed in accordance with the present invention for use with the plating rack of FIG. 1. The product substrate assembly 20 is a one-piece injection molded unit made of a platable plastic such as ABS, nylon and the like. The product substrate assembly 20 comprises a plurality of product substrates 21 which, in the embodiment shown, are automobile window regulator handles. The product substrates 21 are attached to a pair of overflow assemblies 22. Each overflow assembly includes an overflow framework, which in the embodiment shown comprises a generally horizontal primary support 23 and a plurality of secondary supports 24 which extend forwardly from the primary support 23 to the product substrates 21.

In the embodiment shown, the secondary supports 24 are attached to the back side of the product substrates 21. The secondary supports 24 have a narrow cross-section adjacent the product substrate 21 to facilitate detachment of the product substrate 21 from the secondary support and to minimize the size of the blemish which remains on the back side of the product substrate.

The secondary supports are attached to the product substrates at locations other than the gate location, i.e. the location at which molten plastic enters the mold cavity for the product substrate. In such an arrangement, molten plastic flows into the mold cavity for the product substrate and overflows into a mold cavity for the product substrate and overflows into a mold cavity for the overflow assembly.

The overflow assembly 22 further comprises a pair of end clips 26 for releasably attaching the product substrate assembly 20 to the side rails 13 of the framework 11 of the electroplating rack 10. The end clips 26 are generally as described in U.S. Pat. No. 4,714,535. In the embodiments shown, end clips 26 comprise inner and outer fingers 27 and 28 respectively, which extend rearwardly at each end of the primary support 23. The fingers 27 and 28 are spaced apart forming a slot 29 having a width about equal to the diameter of the side rails 13 of the plating rack framework 11 to which it is attached. Outer finger 28 curves toward the inner finger 27 so that the opening into slot 29 is slightly less than the diameter of the side rails 13.

The product substrate assembly 20 is mounted on the electroplating rack by pressing the side rail 13 in to the slot 29 so that the fingers 27 and 28 capture the side rail 13 and hold it firmly within the slot 29 as shown in FIG. 3. Such an arrangement not only keeps the product substrate assembly 20 firmly attached to the plating rack 10, but assures continuous electrical contact between the plating rack 10 and an electrolessly plated product substrate assembly 20.

In the embodiment shown, the outer finger 28 is slightly longer than the inner finger 27. In such an arrangement, the outer finger 28 acts as a hook which resists disengagement from the side rail 13 when the overflow assembly 22 is pulled laterally toward the center of the electroplating rack, as occurs, for example, during the mounting of the product substrate assembly 20 on the electroplating rack. It is apparent, however, that arrangements in which the fingers are the same size or where the outer finger 28 is shorter than the inner finger 27 may be used if desired.

With reference to FIG. 3, the overflow assembly 22 comprises a pair of center guides 32 each having a pair of fingers 33 and 34 which extend rearwardly from the primary support 23. The fingers 33 and 34 form slots 35 for receiving the center rails.

In the embodiment shown, the center guides 32 do not clip onto the center rails 14 but rather provide a means for properly aligning the product substrate assembly 20 on the electroplating rack 10 and for providing additional electrical contacts with the electroplating racks. It is apparent, however, that if desired, center clips similar to the end clips 26 could be provided rather than center guides. It is further apparent that the center clips or guides may be simply omitted.

During electroplating, the framework of the plating rack and the product substrate assemblies mounted on the framework are immersed in an electroplating bath. Such baths typically have a plurality of anodes aligned in a generally straight line adjacent opposite sides of the plating tank. Because the center rails 14 of the plating rack are spaced apart forwardly from the side rails 13, the product substrates 21 adjacent the side rails 13 of the plating rack 10 tend to be spaced apart farther from the anodes during electroplating than the product substrates 21 adjacent the center rail 14 of the electroplating rack 10. Such an arrangement is preferred as it tends to minimize the difference in current density at the product substrates 11 near the side rails 22 of the electroplating rack and at the product substrates 11 near the center rail 14.

Before electroplating, the product substrate assembly 20 is electrolessly plated to establish a thin conductive metal layer over the product substrate assembly 20. This thin metal layer then acts as a buss to enable a thicker metal coating to be built up during the subsequent electroplating process.

In the electroless plating process, the surface of the clips 26, primary support 23, secondary support 24, and product substrates 21 must all be electrolessly plated to assure an electrical connection between the electroplating rack and the product substrates during subsequent electroplating. Because the initial thin metal layer is deposited chemically, these surfaces must be free of contact with other objects. This means that the clips 26 which are used to mount the product substrate assembly 20 on the electroplating rack cannot be used in the same manner to mount the product substrate assembly on the electroless plating rack. If they were, the surfaces of the clips 26 in contact with the electroless plating rack framework would not be electrolessly plated with the result that the clips 26 would be unable to make the required electrical contact with electroplating rack during electroplating.

Accordingly, the overflow assembly 22 of the product substrate assembly 10 is designed to be mounted on the framework of an electroless plating rack without utilizing the contact area of the clips 26, i.e., the portions of the clips 26 which engage and contact the framework of the electroplating rack. As shown in FIGS. 2 and 3, the clips 26 form an enlarged end unit which can be used for mounting the product substrate assembly 20 on the framework of an electroless plating rack in the manner described in U.S. Pat. No. 4,714,535. It is equally apparent that the design of the product substrate assembly may vary. For example, in the above-described embodiment, the overflow assembly comprises a pair of generally horizontal primary supports. It is apparent that other overflow assemblies comprising, for example, a single primary support with secondary supports branching off the primary support may be used.

The means for releasably engaging the framework of an electroplating rack in the above embodiment comprised a clip 26 at each end of the primary support 23. It is apparent that the design, number, and location of the clips required in a particular application will vary according to the design of the runner system and the design of the plating rack framework. Moreover, means for releasably engaging the electrolytic plating rack framework other than clips may be used.

It is equally apparent that the means for releasably engaging the framework of an electroless plating rack may vary. For example, rather than providing a member such as the enlarged end unit of the overflow assembly as described above which is captured by the electroless plating rack framework, the overflow assembly may comprise a member which captures the electroless plating rack framework. Exemplary clips and engaging means suitable for use in the present invention are shown in U.S. Pat. No. 4,714,535.

If desired, a spacer may be provided for maintaining a separation between the product substrates of adjacent product substrate assemblies. Suitable spacers are shown, for example, in U.S. Pat. No. 4,714,535.

As shown in FIG. 2, shields or robbers 30 may be incorporated into the overflow assembly to reduce the current density at high current density locations, e.g. sharp edges. Shields may also be incorporated to reduce plating on exposed conductive surfaces of electroplating racks to thereby reduce the time, effort, and expense in stripping the plating racks between plating runs.

If desired, the overflow assemblies of the product substrate assemblies may be designed to clip together rather than, or in addition to, the plating racks. This may eliminate the need for and associated expense of, building the plating racks in the first place.

The use of an overflow assembly as described herein provides several unique advantages. First, it provides all of the advantages of the runner systems described in U.S. Pat. No. 4,714,535. Such advantages include the elimination of contact between operators and the actual product substrates with a concomitant reduction in the number of rejected parts and the elimination of the need for individual rack contacts with a resultant savings in the cost of racks.

Additionally, the overflow assemblies provide positive venting of the mold cavity during molding. This allows the use of a tighter parting or joint line and a substantial reduction or, in some cases, a total elimination of flash, i.e., overflow of plastic material into the parting line. Moreover, by designing the mold so that the cavity for the overflow assembly connects with the cavity for the product substrate at about the last-to-fill locations of the product substrate cavity, "burning" of the product substrates due to entrapped hot gases within the product substrate cavities is eliminated.

The preceding description has been presented with reference to several presently preferred embodiments of the invention which are shown in the accompanying drawings. Workers skilled in the art and technology to which this invention pertains will appreciate that other alterations or changes in the described structures can be practiced without meaningfully departing from the principles, spirit and scope of this invention.

Accordingly, the foregoing description should not be read as pertaining only to the precise structures described, but rather should be read consistent with and as support for the following claims which are to have their fullest fair scope.

What is claimed is:

1. A product substrate assembly mountable on the framework of a plating rack comprising:

at least one overflow assembly comprising an overflow framework and means for releasably engaging the framework of a plating rack; and at least one product substrate removably attached to the overflow assembly.

2. A product substrate assembly as claimed in claim 1 wherein the plating rack is an electroplating rack and;

the means for releasably engaging the framework of the electroplating rack comprises at least one clip for releasably gripping the framework of the electroplating rack.

3. A product substrate assembly as claimed in claim 1 wherein the plating rack is an electroless plating rack and;

the means for releasably engaging the framework of the electroless plating rack comprises at least one member which releasably captures the framework of the electroless plating rack.

4. A product substrate assembly as claimed in claim 1 wherein the plating rack is an electroless plating rack and the means for releasably engaging the framework of the electroless plating rack comprises at least one member which is releasably captured by the framework of the electroless plating rack.

5. A product substrate assembly as claimed in claim 1 wherein the overflow assembly comprises first means for releasably engaging the framework of an electroplating rack and second means for releasably engaging the framework of an electroless plating rack.

6. A product substrate assembly releasably attachable to the framework of an electroplating rack comprising:

an overflow assembly comprising at least one primary support, at least one secondary support extending from the primary support, and clip means attached to the primary support for releasably gripping the framework of the electroplating rack; and a product substrate removably attached to each secondary support.

7. A product substrate assembly as claimed in claim 6 wherein the overflow assembly further comprises means for releasably engaging the framework of an electroless plating rack.

8. A product substrate assembly mountable on the framework of an electroless plating rack comprising:

an overflow assembly comprising at least one primary support, at least one secondary support extending from the primary support, and means attached to the primary support for releasably engaging the framework of the electroless plating rack; and a product substrate removably attached to each secondary support.

9. A product substrate assembly as claimed in claim 8 wherein the means for releasably engaging the framework of the electroless plating rack comprises at least one engaging member which releasably captures the framework of the electroless plating rack.

10. A product substrate assembly as claimed in claim 9 wherein the engaging member comprises a clip for releasably gripping the framework of the electroless plating rack.

11. A product substrate assembly as claimed in claim 8 wherein the means for releasably engaging the framework of the electroless plating rack comprises at least one engaging member which is releasably captured by the framework of the electroless plating rack.

* * * * *